US006196667B1

(12) United States Patent
Hiroki et al.

(10) Patent No.: US 6,196,667 B1
(45) Date of Patent: Mar. 6, 2001

(54) LIQUID DISCHARGING HEAD, METHOD OF MANUFACTURING THE LIQUID DISCHARGING HEAD, HEAD CARTRIDGE CARRYING THE LIQUID DISCHARGING HEAD THEREON AND LIQUID DISCHARGING APPARATUS

(75) Inventors: Tomoyuki Hiroki, Zama; Masahiko Ogawa, Hino; Masami Ikeda, Tokyo; Ichiro Saito, Yokohama; Hiroyuki Ishinaga, Tokyo; Yoshiyuki Imanaka, Kawasaki; Teruo Ozaki, Yokohama; Masahiko Kubota, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/206,279

(22) Filed: Dec. 7, 1998

(30) Foreign Application Priority Data

Dec. 5, 1997 (JP) ..... 9-336105
Dec. 4, 1998 (JP) ..... 10-346074

(51) Int. Cl.[7] ..... B41J 2/05
(52) U.S. Cl. ..... 347/65; 347/63; 347/56
(58) Field of Search ..... 347/65, 63, 94, 347/56, 44

(56) References Cited

U.S. PATENT DOCUMENTS

| | | | |
|---|---|---|---|
| 4,611,219 | 9/1986 | Sugitani et al. | 346/140 R |
| 4,723,129 | 2/1988 | Endo et al. | 346/1.1 |
| 5,479,197 | 12/1995 | Fujikawa et al. | 347/63 |
| 5,580,468 | 12/1996 | Fujikawa et al. | 216/27 |
| 5,880,752 * | 3/1999 | Weber et al. | 347/15 |
| 5,943,074 * | 8/1999 | Kashino et al. | 347/54 |
| 6,007,187 * | 12/1999 | Kashino et al. | 347/65 |

FOREIGN PATENT DOCUMENTS

| | | |
|---|---|---|
| 0 721 841 | 7/1996 | (EP) . |
| 0 737 580 | 10/1996 | (EP) . |
| 0 778 133 | 6/1997 | (EP) . |
| 61-59911 | 5/1979 | (JP) . |
| 61-59914 | 3/1980 | (JP) . |
| 9-201966 | 8/1997 | (JP) . |

* cited by examiner

*Primary Examiner*—John Barlow
*Assistant Examiner*—Blaise L Mouttet
(74) *Attorney, Agent, or Firm*—Fitzpatrick, Cella, Harper & Scinto

(57) ABSTRACT

A liquid discharging head has at least a discharge port for discharging liquid therefrom, a liquid flow path communicating with the discharge port to supply the liquid to the discharge port, a substrate provided with a heating member for creating a bubble in the liquid filling the liquid flow path, and a movable member having a movable portion having its free end at the discharge port side and provided at a location facing the heating member of the substrate with a gap with respect to the substrate, a supported and fixed portion supported on and fixed to the substrate, and a supporting portion provided near the supported and fixed portion of the movable portion. The free end of the movable member is displaced toward the discharge port side about the fulcrum portion of the movable member by pressure produced by the bubble being created to thereby discharge the liquid from the discharge port. The movable member is formed of a silicon material and has a bent portion forming the gap, and the fulcrum portion has a curved surface shape.

27 Claims, 12 Drawing Sheets

LIQUID DISCHARGING HEAD, METHOD OF MANUFACTURING THE LIQUID DISCHARGING HEAD, HEAD CARTRIDGE CARRYING THE LIQUID DISCHARGING HEAD THEREON AND LIQUID DISCHARGING APPARATUS

BACKGROUND OF THE INVENTION

1. Field of the Invention

This invention relates to a liquid discharging head for discharging desired liquid by the creation of bubbles caused by making heat energy act on the liquid, a method of manufacturing the liquid discharging head, a head cartridge carrying the liquid discharging head thereon and a liquid discharging apparatus. The invention particularly relates to a liquid discharging head having a movable member displaceable by the utilization of the creation of bubbles, a method of manufacturing the liquid discharging head, a head cartridge carrying the liquid discharging head thereon and a liquid discharging apparatus.

The word "recording" in the present invention means not only imparting images having meanings such as characters and figures to a recording medium, but also imparting images having no meaning such as patters to the recording medium.

2. Related Background Art

There is known an ink jet recording method, i.e., a so-called bubble jet recording method of giving energy such as heat to ink to thereby create in the ink a state change resulting in a steep volume change (creation of a bubble), discharging the ink from a discharge port by an acting force based on the state change, causing the ink to adhere onto a recording medium and effecting image formation. A recording apparatus using this bubble jet recording method, as disclosed in Japanese Patent Publication No. 61-59911 and Japanese Patent Publication No. 61-59914, is generally provided with a discharge port for discharging ink therefrom, an ink flow path communicating with this discharge port, and a heating member (electro thermal converting member) as energy generating means disped in the ink flow path for discharging the ink.

According to the recording method as described above, images of high dignity can be recorded at a high speed and with low noise and also, in a head for carrying out this recording method, discharge ports for discharging the ink therefrom can be disposed highly densely, and this leads to many excellent points that recorded images of high resolution and further, color images can be easily obtained by a compact apparatus, etc. In recent years, this bubble jet recording method has been utilized in many office instruments such as printers, copying apparatuses and facsimile apparatuses, and has come to be utilized even in an industrial system such as a textile printing apparatus.

So, some of the inventors have returned to the principle of liquid discharge and have energetically carried out researches to provide a novel liquid discharging method utilizing bubbles which could heretofore not be obtained and a head or the like used therein, and filed Japanese Patent Laid-Open Application No. 9-201966, etc.

A prior-art liquid discharging method disclosed in Japanese Patent Laid-Open Application No. 9-201966, etc. and a head used therein will now be described with reference to FIGS. 12A to 12D, etc. of the accompanying drawings. FIGS. 12A to 12D illustrate the principle of discharge in the prior-art liquid discharging head, and is a cross-sectional view in the direction of a liquid flow path. FIG. 13 is a fragmentary broken-away perspective view of the liquid discharging head shown in FIGS. 12A to 12D. The liquid discharging head shown in FIGS. 12A to 12D and FIG. 13 is of the most basic construction in which when liquid is to be discharged, the direction of propagation of pressure based on a bubble and the direction of growth of the bubble are controlled to thereby improve discharging force and discharging efficiency.

The words "upstream" and "downstream" used in the following description are represented as expressions with respect to the direction of flow of liquid going from a supply source of liquid toward discharge ports via above a bubble creating area (or a movable member), or with respect to the direction in this construction.

The "downstream side" with respect to the bubble itself represents the discharge port side portion of the bubble which is regarded as directly acting on chiefly the discharge of a liquid droplet. More specifically, it means a bubble created at the downstream side with respect to the direction of flow or the direction in the construction, relative to the center of the bubble, or an area downstream of the center of the area of a heat generating member.

Further, "comb-teeth" means a shape in which the fulcrum portion of the movable member is a common portion and the front of the free end thereof is opened.

In the example shown in FIGS. 12A to 12D, the liquid discharging head is such that as a discharge energy generating element for discharging the liquid, a heating member 102 for making heat energy act on the liquid (in the present example, a heat generating resistance member of a shape of 40 $\mu$m×105 $\mu$m) is provided on an element substrate 101 and liquid flow paths 103 are disposed on the element substrate 101 correspondingly to the heating member 102. The liquid flow paths 103 communicate with discharge ports 104 and also communicate with a common liquid chamber 105 for supplying the liquid to the plurality of liquid flow paths 103, and receive from this common liquid chamber 105 an amount of liquid corresponding to the liquid discharged from the discharge ports 104.

On the element substrate 101 for these liquid flow paths 103, a plate-like movable member 106 formed of a resilient material such as a metal and having a flat portion is provided in a cantilever fashion so as to be opposed to the aforementioned heating member 102. One end of this movable member 106 is fixed to a pedestal (support member) 107 or the like formed by patterning photosensitive resin or the like on the wall of the liquid flow paths 103 or the element substrate 101. Thereby, the movable member 106 is held on the pedestal 107, and a fulcrum (fulcrum portion) 108 is constituted.

Also, by making the movable member 106 comb-teeth-like, the movable member 106 can be made simply and inexpensively, and the alignment thereof with the pedestal 107 can be done easily.

This movable member 106 is disposed at a distance of the order of 15 um from the heating member 102 in such a manner as to cover the heating member 102 at a location facing the heating member 102 so as to have the fulcrum (fulcrum portion: fixed end) 108 upstream of a great flow flowing from the common liquid chamber 105 to the discharge port 104 side via above the movable member 106 by the discharging movement of the liquid, and have a free end (free end portion) 109 downstream with respect to the fulcrum 108. The space between the heating member 102 and the movable member 106 provides a bubble creating area 110.

The heating member 102 is caused to generate heat to thereby make the heat act on the liquid in the bubble creating area 110 between the movable member 106 and the heating member 102, thus causing the liquid to create a bubble 111 based on a film boiling phenomenon as described in U.S. Pat. No. 4,723,129, etc. (see FIG. 12B). Pressure based on the creation of the bubble 111 and the bubble 111 preferentially act on the movable member 106, which is thus displaced so as to be greatly opened toward the discharge port 104 side about the fulcrum 108, as shown in FIGS. 12B and 12C or FIG. 13. By the displacement or displaced state of the movable member 106, the propagation of the pressure based on the creation of the bubble 111 or the growth of the bubble 111 itself is directed to the discharge port 104 side. Also, at this time, the bubbling power of the bubble 111 becomes easy to direct to the discharge port 4 side because the tip end portion of the free end 109 has a width, and a fundamental improvement in the discharging efficiency and discharging force or discharging speed of a liquid droplet can be achieved.

As described above, the technique disclosed in Japanese Patent Laid-Open Application No. 9-201966, etc. is the technique of positively controlling the bubble by making the positional relation between the fulcrum and the free end of the movable member in the liquid path into a relation in which the free end is located at the discharge port side, i.e., the downstream side, and disposing the movable member in face-to-face relationship with the heating member or the bubble creating area.

As described above, the pedestal is provided on the fixed portion of the movable member, whereby a gap of the order of 1 to 20 $\mu$m is formed between the movable member and the heating member, and the effect of improving the liquid discharging efficiency by the movable member is sufficiently derived. Thus, according to a liquid discharging head or the like based on the very novel principle of discharge as described above, the combined effect of the bubble created and the movable member displaced thereby can be obtained and the liquid near the discharge port can be efficiently discharged and therefore, the liquid discharging efficiency is improved as compared with the discharging method and head of the prior-art bubble jet type.

While various materials are conceivable as the material of the movable member used in the above-described liquid discharging head, nickel which is excellent in resiliency is generally used in order to efficiently utilize the pressure by the creation of the bubble for the discharging of the liquid.

However, the adoption of a construction in which a pedestal is provided on the fixed portion of the movable member in the liquid discharging head leads to the inconvenience that the step of forming the movable member becomes complicated. Also, when in such construction, an attempt is made to firmly effect the fixing of the movable member, it is necessary to secure a certain degree of length of the pedestal portion in the direction of ink flow, but if the pedestal thus becomes long, the pedestal will occupy a portion of the flow paths or the liquid chamber, and this has led to the fear that, particularly when it is desired to make the head compact or the flow paths are arranged very densely, the ink supply characteristic cannot be sufficiently displayed.

SUMMARY OF THE INVENTION

The present invention has been made in view of the above-noted problem and has as its object to provide a liquid discharging head which can be improved in ink supply characteristic and reliability and can be simplified in the manufacturing process, a method of manufacturing the liquid discharging head, a head cartridge carrying the liquid discharging head thereon and a liquid discharging apparatus.

To achieve the above object, the liquid discharging head of the present invention is a liquid discharging head having at least a discharge port for discharging liquid therefrom, a liquid flow path communicating with the discharge port to supply the liquid to the discharge port, a substrate provided with a heating member for creating a bubble in the liquid filling the liquid flow path, and a movable member having a movable portion having its free end at the discharge port side and provided at a location facing the heating member of the substrate with a gap with respect to the substrate, a supported and fixed portion supported on and fixed to the substrate, and a supporting portion provided near the supported and fixed portion of the movable portion, the free end of the movable member being displaced toward the discharge port side about the fulcrum portion of the movable member by pressure produced by the bubble being created to thereby discharge the liquid from the discharge port, characterized in that the movable member is formed of a silicon material and has a bent portion forming the gap, and the fulcrum portion has a curved surface shape.

Thereby, it becomes unnecessary to use a pedestal as in the prior art and therefore, it becomes easy to secure the volume of the liquid chamber and the ink supply characteristic is improved. Also, the movable member is formed of a silicon material and the fulcrum portion of the movable member made into a curved surface shape, whereby the mechanical durability of the movable member is improved and further, the reliability of the liquid discharging head is improved.

Also, silicon is contained in the material of the movable member, whereby when the other portions of the liquid discharging head are formed of a semiconductive material such as silicon, it is possible to form the entire liquid discharging head by a semiconductor process and therefore, the manufacturing process for the liquid discharging head is simplified.

Further, it is preferable that the material of the movable member be silicon nitride, silicon oxide or silicon carbide.

Also, a construction in which a closely contacting layer is provided between the supported and fixed portion and the substrate of the movable member is adopted, whereby the joint strength between the supported and fixed portion and the substrate of the movable member is increased and the mechanical durability of the movable member is more improved.

Further, it is preferable that tantalum be contained in the material of the closely contacting layer and further, it is preferable that the material of the closely contacting layer be tantalum pentoxide.

The method of manufacturing the liquid discharging head of the present invention is a method of manufacturing a liquid discharging head provided with a discharge port for discharging liquid therefrom, a liquid flow path communicating with the discharge port to supply the liquid to the discharge port, a substrate provided with a heating member for creating a bubble in the liquid filling the liquid flow path, and a movable member having a movable portion having its free end at the discharge port side and provided at a location facing the heating member of the substrate with a gap with respect to the substrate, a supported and fixed portion supported on and fixed to the substrate, and a supporting portion provided near the supported and fixed portion of the movable portion, the free end of the movable member being displaced toward the discharge port side about a fulcrum portion constructed near the supported and fixed portion of the movable member with respect to the substrate by pressure produced by the bubble being created, thereby discharging the liquid from the discharge port, characterized by the step of forming a gap forming member for forming the gap on the substrate, the step of forming on the substrate and the gap forming member a base material layer for the movable member formed of a silicon material forming the movable member, the step of patterning the base material layer for the movable member and forming the movable member, and the step of removing the gap forming member, and having the step of forming that portion of the gap forming member which forms the fulcrum portion of the movable member into a curved surface shape before the step of forming on the substrate and the gap forming member the base material layer for the movable member forming the movable member.

Thereby, there is manufactured a liquid discharging head in which when the movable member is displaced toward the discharge port side about the fulcrum portion, a load applied to the fulcrum portion is dispersed, whereby the mechanical reliability of the movable member is improved.

Also, it is preferable that the step of forming that portion of the gap forming member which forms the fulcrum portion of the movable member into a curved surface shape have the step of forming resist for patterning the gap forming member on the gap forming member, and the step of removing that portion of the gap forming member which is not covered with the resist by etching.

Further, the closely contacting property between the gap forming member and the resist is made weaker than the closely contacting property between the gap forming member and the substrate, whereby the etching progressing speed on the joined surface of the gap forming member and the resist becomes higher than that on the joined surface of the gap forming member and the substrate and therefore, a concave curved surface-like slope is formed on the end portion of the gap forming member.

Furthermore, as the material of the resist, use is made of a material in which the selection ratio of the etching to the gap forming member is about 1:1, whereby the gap forming member is etched in the direction of thickness thereof and at the same time, the resist and the gap forming member are side-etched and therefore, the end portion of the gap forming member becomes a smooth curved surface-like shape.

Also, a construction is adopted which has the step of removing a corner portion formed on the boundary between the surface of the gap forming member and that portion forming the fulcrum portion of the movable member after the step of forming that portion of the gap forming member which forms the fulcrum portion of the movable member into a curved surface shape, whereby the fulcrum portion of the movable member becomes a smoother curved surface shape and therefore, the load applied to the fulcrum portion of the movable member is further dispersed and thus, the mechanical durability of the movable member is more improved.

Further, it is preferable that the step of removing a corner portion formed on the boundary between the surface of the gap forming member and the portion forming the fulcrum portion of the movable member comprise the step of carrying out heat treatment for fusing the corner portion of the gap forming member.

Further, as the material of the gap forming member, use may be made of highly heat-resisting resist having a feature that when exposure and developing process are carried out, a convex curved surface-like shape is formed on the end portion.

Also, by making the material of the movable member contain silicon, when the other members of the liquid discharging head are formed of a semiconductive material such as silicon, it is possible to form the entire liquid discharging head by the semiconductor process and therefore, the process of manufacturing the liquid discharging head is simplified.

Further, it is preferable to use silicon nitride, silicon oxide or silicon carbide as the material of the movable member.

Also, the step of forming a closely contacting layer on the substrate is provided before the step of forming the gap forming member for forming the gap on the substrate, whereby there is manufactured a liquid discharging head in which the strength of the connection between the supported and fixed portion of the movable member and the substrate is increased and the mechanical durability of the movable member is more improved.

The head cartridge of the present invention has the above-described liquid discharging head of the present invention and a liquid container for holding the liquid to be supplied to the liquid discharging head.

The liquid discharging apparatus of the present invention has the above-described liquid discharging head of the present invention, and driving signal supplying means for supplying a driving signal for discharging the liquid from the liquid discharging head.

Also, the liquid discharging apparatus of the present invention may be of a construction having the above-described liquid discharging head of the present invention, and recording medium conveying means for conveying a recording medium receiving the liquid discharged from the liquid discharging head.

Further, it is preferable that the liquid discharging apparatus of the present invention be designed to discharge ink from the liquid discharging head, and cause the ink to adhere to a recording medium to thereby effect recording.

DESCRIPTION OF THE PREFERRED EMBODIMENTS

Some embodiments of the present invention will hereinafter be described with reference to the drawings.

Figure 1:
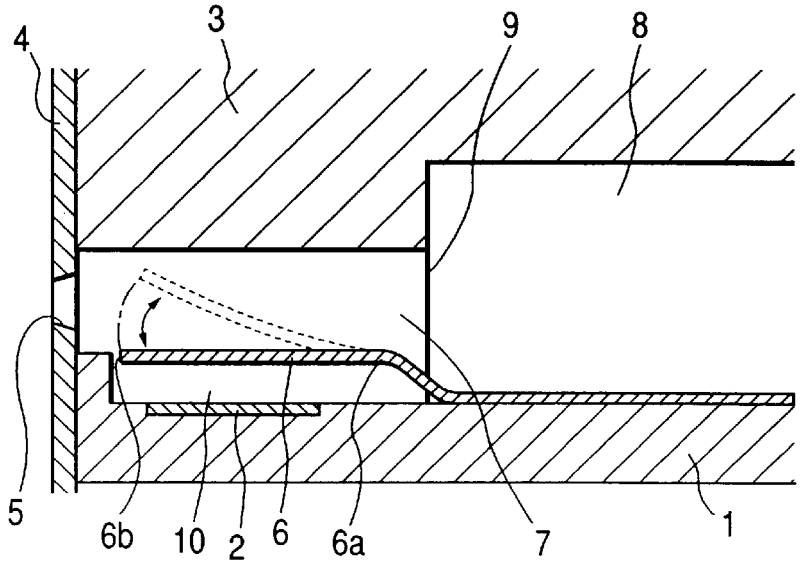
FIG. 1 is a cross-sectional view along the direction of a liquid flow path for illustrating the basic structure of an embodiment of the liquid discharging head of the present invention.

FIG. 1 is a cross-sectional view along the direction of a liquid flow path for illustrating the basic structure of an embodiment of the liquid discharging head of the present invention.

As shown in FIG. 1, this liquid discharging head has an element substrate 1 on which a plurality of heating members 2 (only one of which is shown in FIG. 1) for giving liquid heat energy for creating a bubble are provided in parallel, a top plate 3 joined onto this element substrate 1, and an orifice plate 4 joined to the front surfaces of the element substrate 1 and the top plate 3.

The element substrate 1 comprises a base body of silicon or the like, silicon oxide film or silicon nitride film directed to insulation and heat accumulation and formed on the base body, and an electrical resistance layer and a wiring electrode constituting the heating members 2 and patterned thereon. A voltage is applied from the wiring electrode to the electrical resistance layer and an electric current is supplied to the electrical resistance layer, whereby the heating members 2 generate heat.

The top plate 3 is for constituting a plurality of liquid flow paths 7 corresponding to the heating members 2 and a common liquid chamber 8 for supplying the liquid to the liquid flow paths 7, and is integrally provided with a flow path side wall 9 extending from the ceiling portion thereof to among the heating members 2. The top plate 3 is formed of a silicon material, and can be formed by forming the patterns of the liquid flow paths 7 and the common liquid chamber 9 by etching, or piling a material such as silicon nitride or silicon oxide providing the flow path side wall on the silicon substrate by a conventional film forming method such as CVD, and thereafter etching the portion of the liquid flow paths 7.

The orifice plate 4 is formed with a plurality of discharge ports 5 communicating with the common liquid chamber 8 through the liquid flow paths 7, correspondingly to the respective liquid flow paths 7. The orifice plate 4 is also formed of a silicon material, and is formed, for example, by planing a silicon substrate formed with the discharge ports 5 to a thickness of the order of 10 to 150 $\mu$m. The orifice plate 4 is not always a construction necessary to the present invention, but instead of providing the orifice plate 4, a wall corresponding to the thickness of the orifice plate 4 can be left on the tip end surface of the top plate 3 when the liquid flow paths 7 are formed in the top plate, and the discharge ports 5 can be formed in this portion to thereby provide a top plate with discharge ports.

Further, this liquid discharging head is provided with a cantilever-like movable member 6 disposed in face-to-face relationship with the heating members 2 and directly fixed to the element substrate 1. This movable member 6 has a bent portion by which the movable portion of the movable member 6 has a predetermined gap with respect to the substrate. By the movable member 6 being made into such a shape, the fixing of the movable member 6 can be done firmly and no pedestal is used to form the gap and therefore, the space heretofore occupied by the pedestal can also provide a portion of the liquid chamber and the volume of the liquid chamber can be secured easily. Also, when the movable member 6 is of the above-described construction, the strength of the movable member 6 is more required than in the prior-art construction and therefore, in the present invention, the movable member 6 is constituted by thin film formed of a silicon material such as silicon nitride or silicon oxide. These materials are more excellent in strength than nickel used as the material of the prior-art movable member 6 and also is excellent in its closely contacting property with an inorganic insulating protective layer provided on the surface of the substrate and can therefore display stable performance in the above-described construction. Also, when a cavitation-resisting layer of a material such as Ta is provided on the surface of the substrate 1, the cavitation-resisting layer on that portion of the substrate 1 which is joined with the movable member is removed or a closely contacting layer is provided between the supported and fixed portion of the movable member 6 and the substrate, whereby the closely contacting property between the movable member 6 and the substrate can be improved. Further, the above-mentioned materials are also good in corrosion resistance to liquid of high hydrogen ion exponent (pH).

Also, this movable member 6 is supported on and fixed to the element substrate 1 upstream of a great flow flowing from the common liquid chamber 8 to the discharge port 5 side via above the movable member 6 by the discharging movement of the liquid, and has a fulcrum 6*a* constructed near the bent portion of the movable portion. Further, it is disposed at a predetermined distance from the heating members 2 in such a state as to cover at least a portion of the heating members 2 at a location facing the heating members 2 so as to have a free end 6*b* downstream of the fulcrum 6*a*. Since the movable member 6 of the present invention has a bent portion, a load applied to the fulcrum portion thereof is greater than in the prior-art shape and therefore, it adopts a construction in which it has a curved surface portion in the fulcrum 6*a* portion with a view to more improve the durability of the movable member. Also, the space between the heating members 2 and the movable member 6 provides a bubble creating area 10. The gap between the substrate and the movable member is preferably 1 to 20 $\mu$m, and more preferably 1 to 10 $\mu$m. By doing so, the energy of a bubble can be more efficiently controlled by the movable member and also, the stability of the operation of the movable member can be improved. Also, by the thickness of the movable member being controlled to the order of 5 $\mu$m, the operation following property of the movable member can be increased.

When the heating members 2 are caused to generate heat on the basis of the above-described construction, the heat acts on the liquid in the bubble creating area 10 between the movable member 6 and the heating members 2, whereby a bubble based on the film boiling phenomenon is created on the heating members 2 and grows. Pressure resulting from the growth of this bubble preferentially acts on the movable member 6, and the free end 6*b* of the movable member 6, as indicated by broken lines in FIG. 1, is displaced so as to greatly open about the fulcrum 6*a* toward the discharge port 5 side (the gap provided between the movable member in its steady state and that surface of the flow path which faces the substrate). By the displacement or the displaced state of the movable member 6, the propagation of the pressure based on the creation of the bubble and the growth of the bubble itself are directed to the discharge port 5 side, and the liquid is discharged from the discharge port 5.

That is, the movable member 6 having the fulcrum 6*a* at the upstream side (the common liquid chamber 8 side) of the flow of the liquid in the liquid flow paths 7 and having the free end 6*b* at the downstream side (the discharge port 5 side) is provided on the bubble creating area 10, whereby the direction of propagation of the pressure of the bubble is directed toward the downstream side and thus, the pressure of the bubble directly and efficiently contributes to discharge. The direction itself of growth of the bubble, like the direction of propagation of the pressure, is directed to the downstream direction, and the bubble grows more greatly at the downstream side than at the upstream side. As described above, the direction itself of growth of the bubble is controlled by the movable member and the direction of propagation of the pressure of the bubble is controlled, whereby fundamental discharging characteristics such as the discharging efficiency and the discharging force or the discharging speed can be improved.

On the other hand, when the bubble comes into the disappearing step, the bubble rapidly disappears due to the combined effect with the resilient force of the movable member 6, and the movable member 6 finally returns to its initial position indicated by solid lines in FIG. 1. At this time, the liquid flows in from the upstream side, i.e., the common liquid chamber 8 side to make up for the contracted volume of the bubble in the bubble creating area 10 and to make up for the volume of the discharged liquid, and the refill of the liquid into the liquid flow paths 7 is effected, and this refill of the liquid is effected efficiently and reasonably and stably with the returning action of the movable member 6.

As described above, the movable member 6 in the present embodiment has a curved surface portion on the portion of the fulcrum 6*a* of the movable member 6 and therefore, the load applied to the fulcrum 6*a* when the movable member 6 has opened as indicated by broken lines in FIG. 1 is dispersed. Therefore, the mechanical durability of the movable member 6 is increased and further, the reliability of the liquid discharging head is improved.

The detailed construction of the element substrate in the liquid discharging head shown in FIG. 1 will now be described with reference to FIGS. 2A and 2B.

Figure 2A:
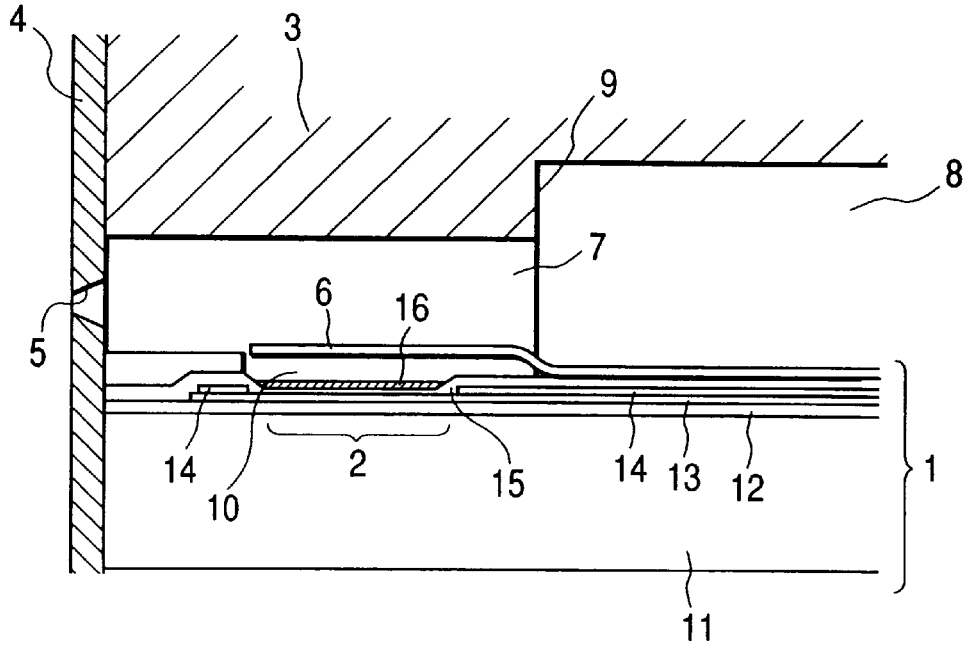
FIGS. 2A and 2B are cross-sectional views of the liquid discharging head shown in FIG. 1.
Figure 2B:
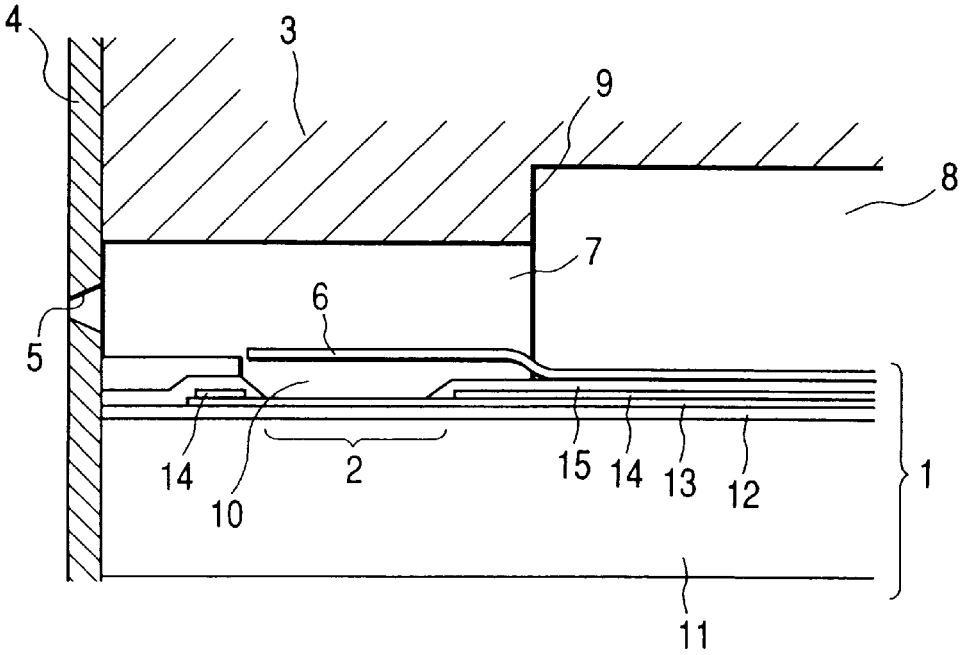

FIGS. 2A and 2B are cross-sectional views of the liquid discharging head shown in FIG. 1, FIG. 2A showing the liquid discharging head having protective film which will be described later, and FIG. 2B showing the liquid discharging head having no protective film.

As shown in FIGS. 2A and 2B, the movable member 6 is provided on the element substrate 1, and the liquid flow path 7 is formed between the top plate 3 and the movable member 6.

The element substrate 1 comprises a base body 11 formed of silicon or the like, silicon film 12 formed thereon and comprising silicon oxide or silicon nitride for the purpose of insulation and heat accumulation, and an electrical resistance layer 13 formed of halnium boride (HfB2), tantalum nitride (TaN), tantalum aluminum (TaAl) or the like constituting a heating member having a thickness of 0.01 to 0.2 $\mu$m and 2 wiring electrodes 14 formed of aluminum or the like having a thickness of 0.2 to 1.0 $\mu$m, both being patterned on the silicon film 12. The heating member 2 is caused to generate heat by a voltage being applied from the wiring electrodes 14 to the electrical resistance layer 13 to thereby supply an electric current to the electrical resistance layer 13. An inorganic insulating protective layer 15 formed of silicon oxide or silicon nitride is formed to a thickness of 0.1 to 0.2 $\mu$m on the electrical resistance layer 13 (i.e., the heating member 2) between the wiring electrodes 14, and further a cavitation-resisting layer 16 formed of tantalum or the like having a thickness of 0.1 to 0.6 $\mu$m is formed thereon and protects the electrical resistance layer 13 from various kinds of liquids including ink.

Particularly, the pressure and shock wave produced during the creation and disappearance of the bubble are very strong and remarkably reduce the durability of hard and fragile oxide film and therefore, tantalum (Ta) or the like which is a metallic material is used as the material of the cavitation-resisting layer 16.

Also, depending on the combination of the liquid, the construction of the liquid flow paths and the resistance material, there may be adopted a construction which does not require the above-described protective layer 15, and an example thereof is shown in FIG. 2B.

As the material of the resistance layer which does not require such a protective layer, mention may be made of iridium=tantalum=aluminum alloy or the like. Particularly, when the liquid in the bubble creating area 10 used for bubbling is separated from the liquid discharged from the liquid flow paths 7 and made suitable for bubbling, there is no hindrance even if the protective layer is absent as described above.

Thus, as the construction of the heating member 2 in the above-described embodiment, the electrical resistance layer 13 (heating portion) between the wiring electrodes 14 may suffice or the protective layer for protecting the electrical resistance layer 13 may be included.

In the present embodiment, as the heating member 2, use is made of one having a heating portion constituted by a resistance layer generating heat in conformity with an electrical signal, whereas the present invention is not restricted thereto, but the heating member can be one which will create a bubble sufficient to discharge the discharge liquid in the bubbling liquid in the bubble creating area. For example, the heating portion may be an optothermal converting member generating heat by receiving light such as a laser or a heating member having a heating portion generating heat by receiving a high frequency.

In the aforedescribed element substrate 1, besides the electrothermal converting members comprised of the electrical resistance layer 13 constituting the heating portion and the wiring electrodes 14 for supplying an electrical signal to the electrical resistance layer 13, a functional element such as a transistor, a diode, a latch or a shift register for selectively driving these electro thermal converting members may be integrally made by a semiconductor manufacturing process.

Also, to drive the heating portions of the electro-thermal converting members provided on the element substrate as described above and discharge the liquid, a rectangular pulse can be applied to the electrical resistance layer 13 through the wiring electrodes 14 to thereby steeply cause the electrical resistance layer 13 between the wiring electrodes 14 to generate heat.

Figure 3:
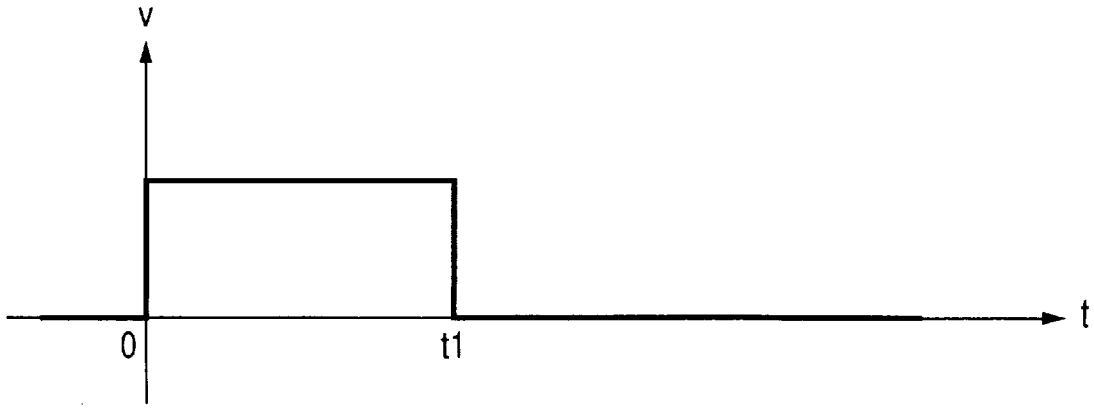
FIG. 3 shows a voltage waveform applied to an electrical resistance layer shown in FIGS. 2A and 2B.

FIG. 3 shows a voltage waveform applied to the electrical resistance layer shown in FIGS. 2A and 2B.

In the liquid discharging apparatus in the above-described embodiment, a voltage of 24 V, a pulse width of 7$\mu$ sec., a current of 150 mA and an electrical signal of 6 kHz were applied to thereby drive the heating members, and by the operation as previously described, ink which was liquid was discharged from the discharge ports. However, the conditions of the driving signal in the present invention is not restricted thereto, but the driving signal can be one which can cause the liquid to bubble properly.

A method of manufacturing the movable member which is the feature of the liquid discharging head of the present embodiment will now be described in detail with reference to FIGS. 4A to 4H. FIGS. 4A to 4H are cross-sectional views illustrating the method of manufacturing the movable member in the liquid discharging head shown in FIG. 1, etc.

Figure 4E:
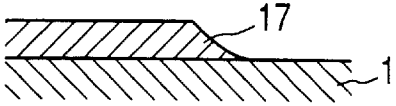
FIGS. 4A, 4B, 4C, 4D, 4E, 4F, 4G and 4H are cross-sectional views showing a method of manufacturing a movable member in the liquid discharging head shown in FIG. 1, etc.
Figure 4F:
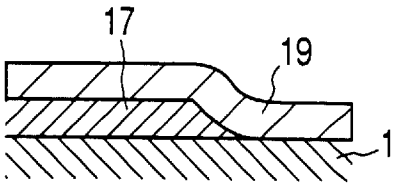
Figure 4G:
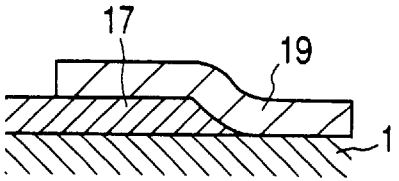
Figure 4H:
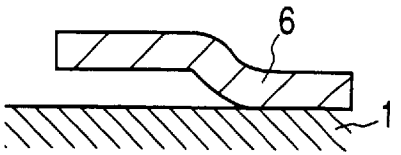
Figure 4A:
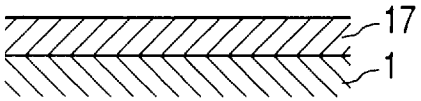
Figure 4B:
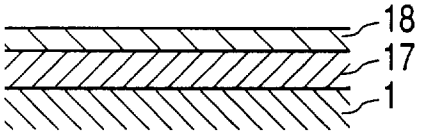

First, as shown in FIG. 4A, BPSG (boron-doped phosphosilicate glass) film 17 is formed on the element substrate 1 by the CVD method or the like. This BPSG film 17 functions as a gap forming member for forming a gap between the movable member and the element substrate, and the film thickness thereof finally corresponds to the gap between the movable member 6 and the heating member. Accordingly, the film thickness of the BPSG film 17 is selected to a value between 1 to 20 $\mu$m at which the liquid discharging effect by the movable member becomes most remarkable in the balance of the entire liquid flow paths.

Figure 4C:
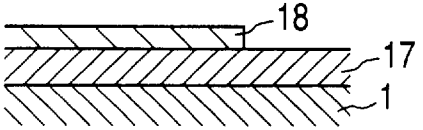

Next, resist 18 for patterning the BPSG film 17 is applied as by spin coating (see FIG. 4B), and is exposed and developed (see FIG. 4C). Thereby, the resist 18 on a portion corresponding to the fulcrum portion of the movable member is removed. However, during the application of the resist 18, the closely contacting property between the BPSG film 17 and the resist 18 is intentionally made weaker than the closely contacting property between the element substrate 1 and the BPSG film 17.

Figure 4D:
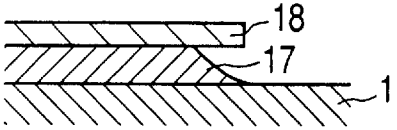

The BPSG film 17 on the portion which is not covered with the resist 18 is removed by effecting wet etching by buffered hydrofluoric acid or dry etching or the like. At this time, the closely contacting property between the BPSG film 17 and the resist 18 is weakened and therefore, on the end portion of the BPSG film 17, the etching progressing speed on the joined surface between the BPSG film 17 and the resist 18 becomes higher than that on the joined surface between the BPSG film 17 and the element substrate 1 and thus, side etching progresses and as the result, the BPSG film 17 assumes a shape having a concave curved slope on the end portion thereof as shown in FIG. 4D.

Next, the remaining resist 18 is removed by plasma ashing by oxygen plasma or by being immersed in a resist removing agent (see FIG. 4E). SiN film (silicon nitride film) 19 which is a base material portion for the movable member forming the movable member is formed on the BPSG film 17 as by the plasma CVD method (see FIG. 4F) and is patterned (see FIG. 4G).

When finally, the wet etching by buffered hydrofluoric acid is effected to thereby remove all the BPSG film 17 remaining under the Sin film 19, the movable member 6 having a curved surface portion outside the fulcrum portion can be formed as shown in FIG. 4H.

While in the present embodiment, description has been made of a case where the material of the movable member is silicon nitride, the movable member can equally be formed by using silicon carbide or silicon oxide with the material gas for film formation changed. As described above, the movable member 6 is formed of a silicon material, whereby when the other members of the liquid discharging head are formed of a semiconductive material such as silicon, it becomes possible to form the entire liquid discharging head by a semiconductor process and therefore, the manufacturing process for the liquid discharging head can be greatly simplified. Further, when the movable member is to be formed by plating, an underlying layer (an electrically conductive layer) is necessary and therefore it has been difficult to form the movable member thinly by a single layer, but it can be easily formed according to the present embodiment.

(Second Embodiment of the Method of Manufacturing the Movable Member of the Liquid Discharging Head)

As shown in FIG. 4E, the shape of the edge portion of the BPSG film 17 which was subjected to side etching is like a quadratic curve, and a smooth curve is obtained in that portion of the movable member 6 which is fixed to the element substrate 1, but a corner remains at the fulcrum side. Thus, the finished movable member still has a corner portion in the fulcrum portion thereof and therefore, it can be further improved for the purpose of improving the mechanical durability of the movable member.

So, the method of manufacturing the movable member of the liquid discharging head in the present embodiment is directed to form also the inside of the fulcrum portion of the movable member into a smooth curved surface.

FIGS. 5A to 5I are cross-sectional views showing a second embodiment of the method of manufacturing the movable member of the liquid discharging head shown in FIG. 1, etc. The manufacturing process for the movable member shown in FIGS. 5A to 5E is similar to the manufacturing process described with reference to FIGS. 4A to 4E and therefore need not be described in detail.

Figure 5A:
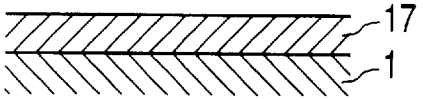
FIGS. 5A, 5B, 5C, 5D, 5E, 5F, 5G, 5H and 5I are cross-sectional views showing a second embodiment of the method of manufacturing the movable member in the liquid discharging head shown in FIG. 1, etc.
Figure 5B:
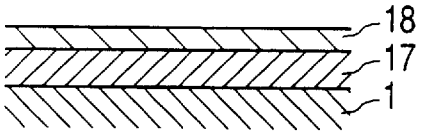
Figure 5C:
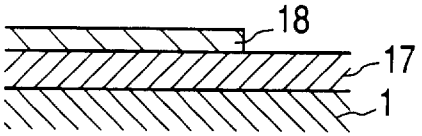
Figure 5D:
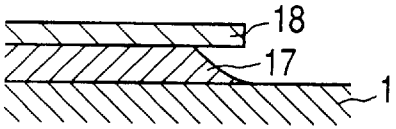
Figure 5E:
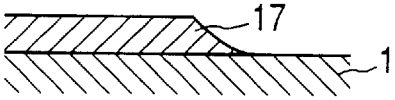
Figure 5F:
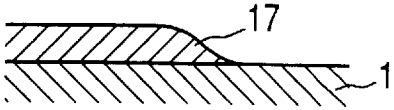
Figure 5G:
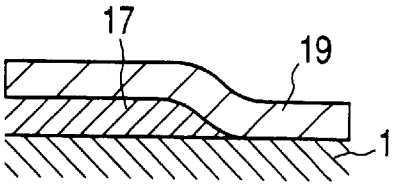
Figure 5H:
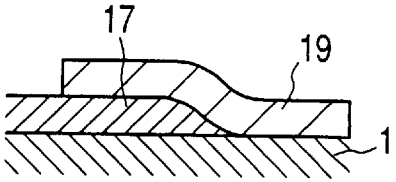
Figure 5I:
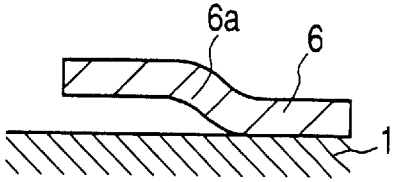

In the present embodiment, heat treatment is applied to the BPSG film 17 in the state shown in FIG. 5E to thereby smooth the corner portion formed on the boundary between the surface of the BPSG film 17 and the curved surface-like slope thereof (see FIG. 5F). Subsequently, SiN film (silicon nitride film) 19 providing the movable member is formed on the BPSG film 17 (see FIG. 5G) and the patterning thereof is done (see FIG. 5H). Finally, when the BPSG film 17 is removed, the movable member 6 having smooth curved surface portions on the fixed portion to the element substrate 1 and the fulcrum 6*a* portion as shown in FIG. 5I can be formed.

According to the above-described manufacturing method, the fulcrum 6*a* of the movable member 6 becomes a smoother curved surface and therefore, the load applied to the fulcrum 6*a* of the movable member 6 is further dispersed and thus, the mechanical durability of the movable member 6 is more improved.

While in the present embodiment, BPSG is used as the gap forming member of the movable member, a material easy to deform at a low temperature such as water glass may be used instead of BPSG to effect heat treatment for smoothing the aforementioned corner portion. Alternatively, instead of heat-treating BPSG, dry or wet soft etching can be effected to thereby smooth the corner portion.

When the soft etching is effected, a material of which the selection ratio (etching rate) with respect to BPSG is about 1:1 is used as the material of the resist 18, and the thickness of the resist 18 is made substantially equal to the film thickness of the BPSG film 17. Thereby, the BPSG film 17 is etched in the direction of film thickness thereof and at the same time, the resist 18 and the BPSG film 17 are side-etched and therefore, the end portion of the BPSG film 17 becomes a smooth curved surface.

(Third Embodiment of the Method of Manufacturing the Movable Member of the Liquid Discharging Head)

FIGS. 6A to 6E are cross-sectional views showing a third embodiment of the method of manufacturing the movable member of the liquid discharging head shown in FIG. 1, etc.

Figure 6A:
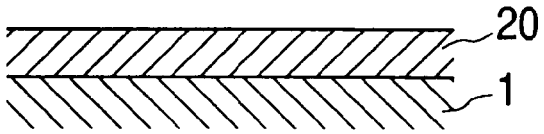
FIGS. 6A, 6B, 6C, 6D and 6E are cross-sectional views showing a third embodiment of the method of manufacturing the movable member in the liquid discharging head shown in FIG. 1, etc.
Figure 6B:
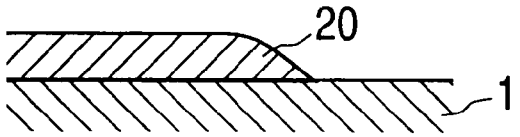
Figure 6C:
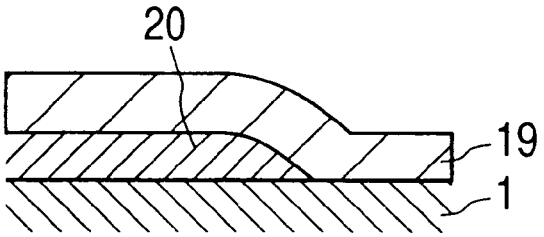
Figure 6D:
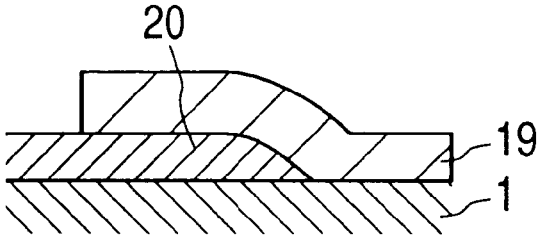
Figure 6E:
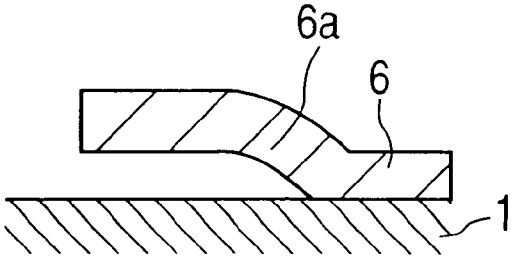

In the present embodiment, highly heat-resisting resist 20 is first applied onto the element substrate 1 by spin coating or the like (see FIG. 6A). Next, the highly heat-resisting resist 20 is exposed and developed to thereby remove the highly heat-resisting resist 20 on a portion corresponding to the fixed portion of the movable member. As the feature when this highly heat-resisting resist 20 is exposed and developed, the shape of the end portion of the highly heat-resisting resist 20 becomes a smooth shape having a convex curved slope as shown in FIG. 6B. Accordingly, when SiN film (silicon nitride film) 19 providing the movable member is formed on the element substrate 1 and the highly heat-resisting resist 20 by a method such as low temperature film formation by CVD (see FIG. 6C) and is patterned (see FIG. 6D) and thereafter the highly heat-resisting resist 20 is removed by wet treatment, there can be formed a movable member 6 having a smooth curved surface portion formed on the fulcrum 6*a* portion as shown in FIG. 6E.

It is necessary that the highly heat-resisting resist 20 be not deformed and deteriorated when the SiN film 19 is formed. For example, the highly heat-resisting resist 20 need have heat resistance of the order of 400° C. when the film formation of the SiN film 19 is effected at the order of 350° C. In this case, it is preferable to use, for example, a polyimide material as the material of the highly heat-resisting resist 20.

(Fourth Embodiment of the Method of Manufacturing the Movable Member of the Liquid Discharging Head)

FIGS. 7A to 7E are cross-sectional views showing a fourth embodiment of the method of manufacturing the movable member of the liquid discharging head shown in FIG. 1, etc.

This embodiment is characterized in that the gap forming member between the element substrate and the movable member is formed by plating.

Figure 7A:
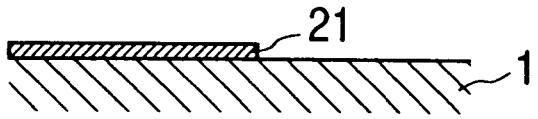
FIGS. 7A, 7B, 7C, 7D and 7E are cross-sectional views showing a fourth embodiment of the method of manufacturing the movable member in the liquid discharging head shown in FIG. 1, etc.
Figure 7B:
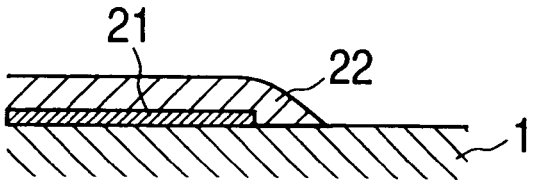
Figure 7C:
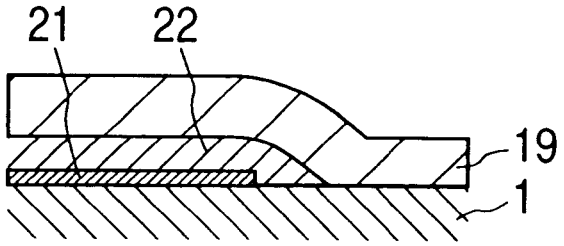

First, an electrode 21 for forming the gap forming member by plating is film-formed on the element substrate 1 and is patterned (see FIG. 7A). Next, a metal such as nickel is grown around the electrode 21 to thereby form plating 22. In the case of the plating 22, the direction of film growth is isotropic and therefore, as shown in FIG. 7B, the plating 22 on the end portion of the electrode 21 assumes a smooth shape having a curved surface portion.

Figure 7D:
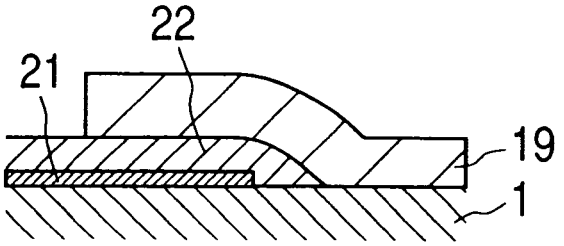
Figure 7E:
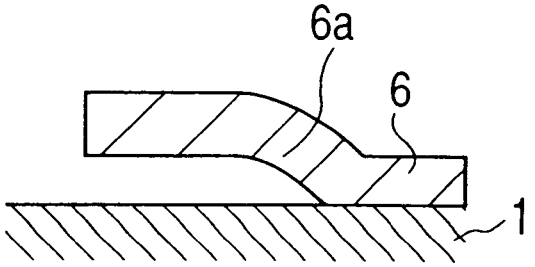

Subsequently, SiN film (silicon nitride film) 19 providing the movable member is formed on the plating 22 and the element substrate 1 (see FIG. 7C) and is patterned (see FIG. 7D). When lastly, the plating 22 and the electrode 21 are removed by wet treatment, there can be formed a movable member 6 having a curved surface portion on the fulcrum 6*a* portion, as shown in FIG. 7E.

(Fifth Embodiment of the Method of Manufacturing the Movable Member of the Liquid Discharging Head)

FIGS. 8A to 8F are cross-sectional views showing a fifth embodiment of the method of manufacturing the movable member of the liquid discharging head shown in FIG. 1, etc.

This embodiment is characterized in that a closely contacting layer 23 is provided on that portion of the element substrate to which the movable member is fixed.

Figure 8A:
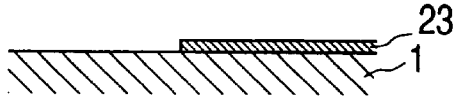
FIGS. 8A, 8B, 8C, 8D, 8E and 8F are cross-sectional views showing a fifth embodiment of the method of manufacturing the movable member in the liquid discharging head shown in FIG. 1, etc.
Figure 8B:
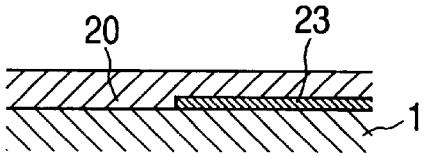
Figure 8C:
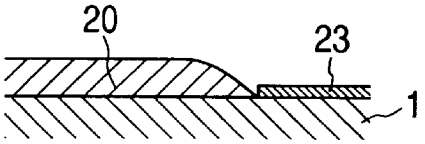
Figure 8D:
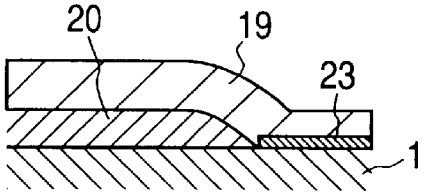
Figure 8E:
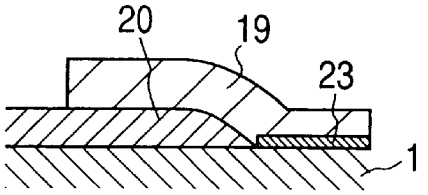

First, the closely contacting layer 23 having the effect of alleviating the stress of the SiN film constituting the movable member and enhancing the closely contacting property and formed of tantalum pentixide (Ta205) or the like is patterned on that portion of the element substrate 1 to which the movable member 6 is fixed (see FIG. 8A). Thereafter, highly heat-resisting resist 20 which is a gap forming member is film-formed on the element substrate 1 and the closely contacting layer 23, and is patterned (see FIG. 8B). Next, the highly heat-resisting resist 20 is exposed and developed to thereby remove the highly heat-resisting resist 20 on a portion corresponding to the fixed portion of the movable member (see FIG. 8C).

Figure 8F:
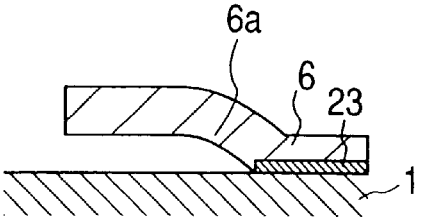

When subsequently, SiN film (silicon nitride film) 19 providing the movable member is formed on the pedestal 23 and the highly heat-resisting resist 20 by a method such as low temperature film formation by CVD (see FIG. 8D) and is patterned (see FIG. 8E), and thereafter the highly heat-resisting resist 20 is removed by wet treatment, a movable member 6 having a smooth curved surface portion formed on the fulcrum 6*a* portion can be formed on the closely contacting layer 23, as shown in FIG. 8F.

As described above, the pedestal 23 is provided on that portion of the element substrate 1 to which the movable member 6 is fixed, whereby the strength of the connection between the supported and fixed portion of the movable member 6 and the element substrate 1 is increased and the mechanical durability of the movable member 6 is more improved. It is apparent that a similar effect can be obtained by adding the closely contacting layer 23 described in the present embodiment to the first, second, third and fourth embodiments as well.

A liquid discharging head cartridge carrying the above-described liquid discharging head thereon will now be schematically described.

Figure 9:
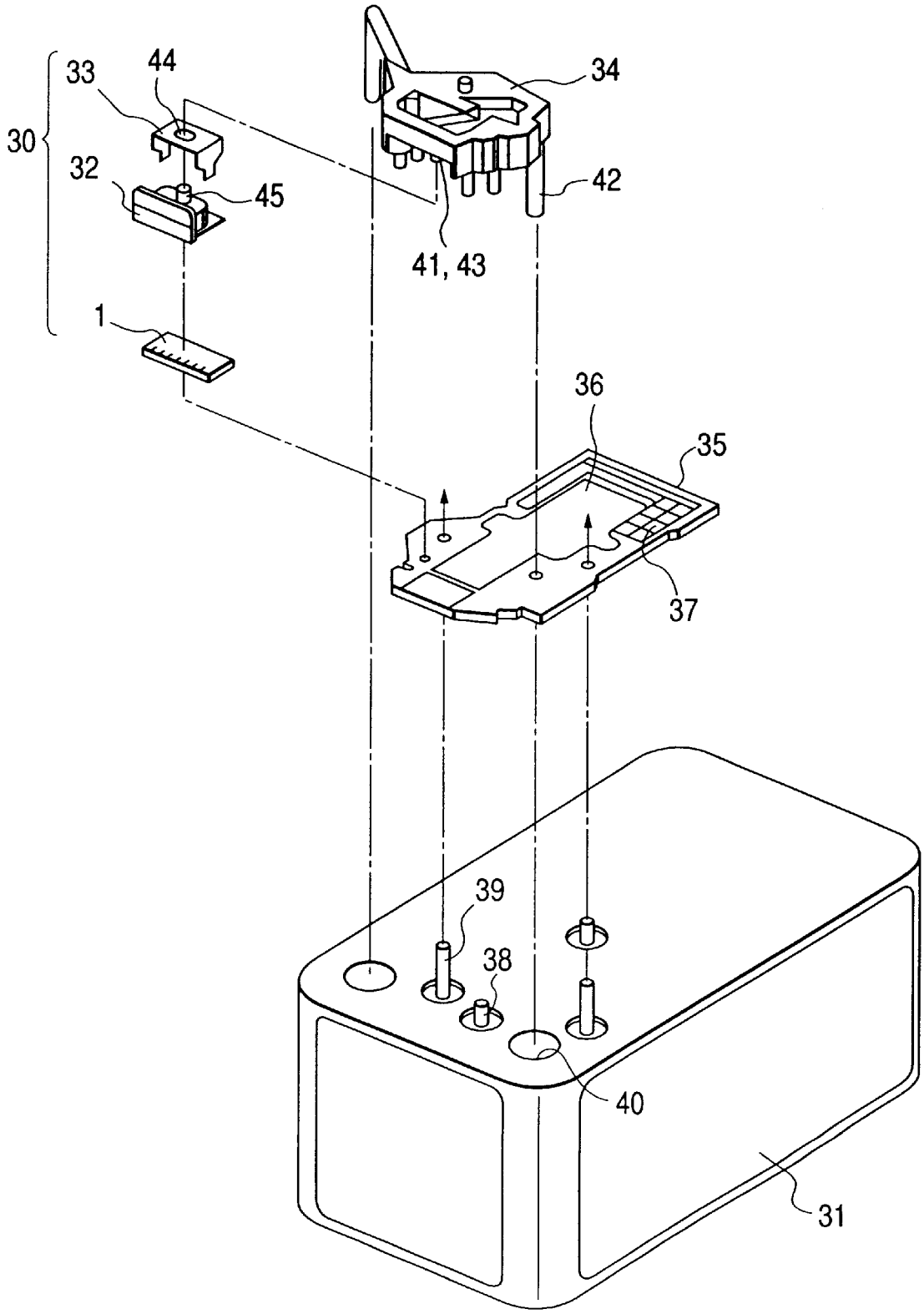
FIG. 9 is a typical exploded perspective view of a liquid discharging head cartridge on which the liquid discharging head of the present invention is carried.

FIG. 9 is a typical exploded perspective view of the liquid discharging head cartridge carrying the aforedescribed liquid discharging head thereon. As shown in FIG. 9, the liquid discharging head cartridge is comprised of chiefly a liquid discharging head portion 30 and a liquid container 31.

The liquid discharging head portion 30 comprises the element substrate 1 provided with the movable member 6 (see FIG. 1, etc.), a grooved member 32 having the top plate 3 and the orifice plate 4 (see FIG. 1, etc.), a pressure bar spring 33, a liquid supply member 34, a support member (aluminum base plate) 35, etc. On the element substrate 1, as previously described, a plurality of heating members 2 (see FIG. 1, etc.) for giving heat to the bubbling liquid are provided in a row, and a plurality of functional elements (not shown) for selectively driving these heating members 2 are provided. The bubble creating area 10 (see FIG. 1, etc.) is formed between the element substrate 1 and the movable member 6, as previously described. The liquid flow paths 7 and the common liquid chamber 8 (see FIG. 1 through which the discharged liquid flows) are formed by the joint of the element substrate 1 and the grooved member 32.

The pressure bar spring 33 is a member for causing a biasing force toward the element substrate 1 to act on the grooved member 32, and by this biasing force, the element substrate 1, the grooved member 32 and a support member 35 which will be described later are made well integral with one another.

The support member 35 is for supporting the element substrate 1, etc., and on this support member 35, there are disposed a printed wiring substrate 36 connected to the element substrate 1 for supplying an electrical signal thereto, and a contact pad 37 connected to the apparatus side to thereby effect the exchange of electrical signals with the apparatus side.

The liquid container 31 contains therein discharge liquid such as ink to be supplied to the liquid discharging head portion 30. Outside the liquid container 31, there are provided a positioning portion 38 for disposing a connecting member for effecting the connection between the liquid discharging head portion 30 and the liquid container 31, and a fixing shaft 39 for fixing the connecting member. The discharge liquid is supplied from the discharge liquid supply path 40 of the liquid container 31 to the common liquid chamber 8 (see FIG. 1) through the supply path 42 of the liquid supply member 34 and through the supply paths 41, 43 and 44 of the respective members.

This liquid container 31 may be refilled with liquid after the consumption of the liquid and used. For this purpose, it is desirable that the liquid container 31 be formed with a liquid inlet. Also, the liquid discharging head portion 30 and the liquid container 31 may be integral with or separable from each other.

Figure 10:
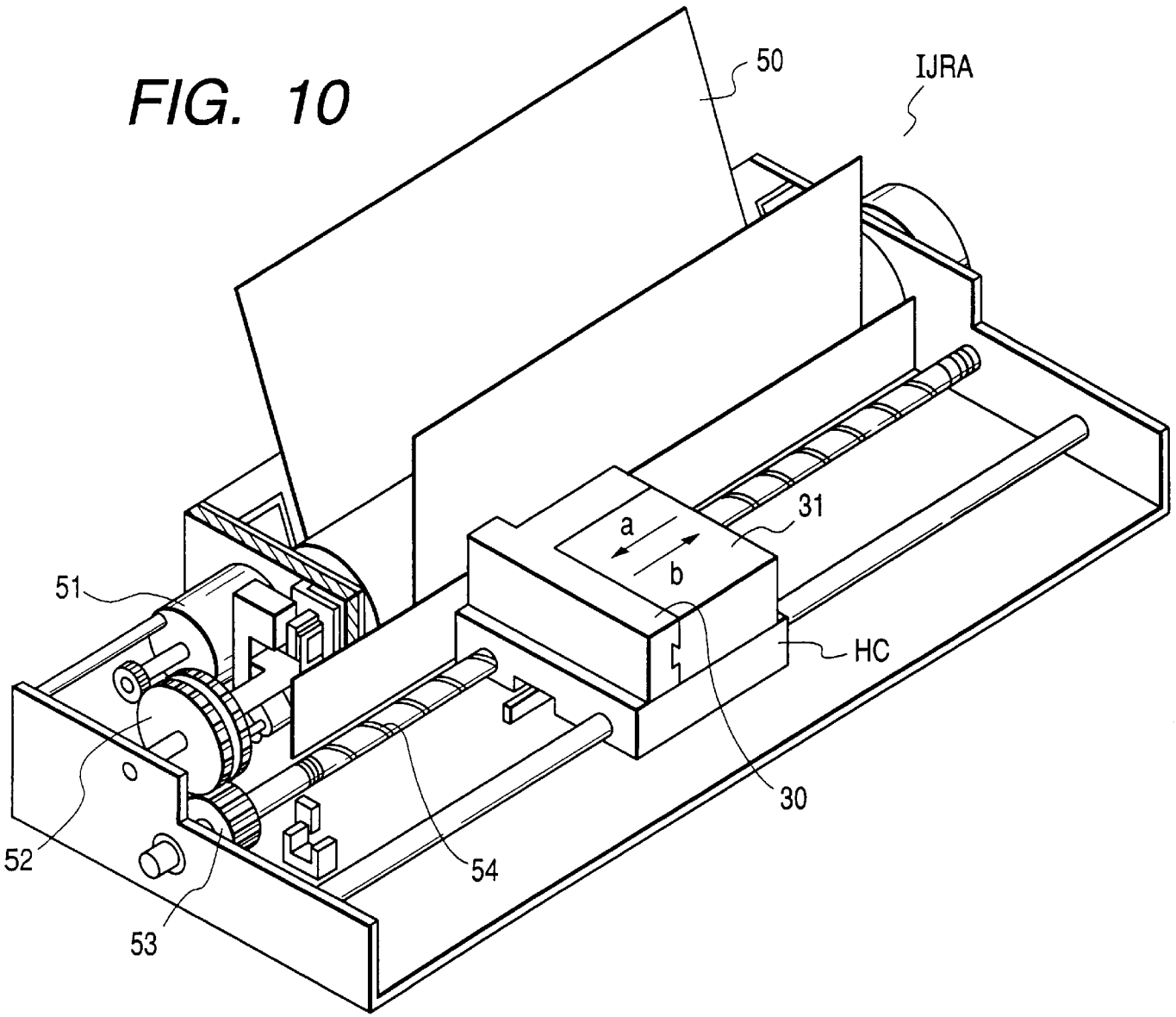
FIG. 10 is a perspective view schematically showing the construction of a liquid discharging apparatus on which the liquid discharging head of the present invention is carried.

A liquid discharging apparatus carrying the above-described liquid discharging head thereon will now be schematically described with reference to FIG. 10. FIG. 10 is a perspective view schematically showing the construction of the liquid discharging apparatus carrying the aforedescribed liquid discharging head thereon.

In the present embodiment, description will be made by the use of particularly an ink jet recording apparatus IJRA using ink as discharge liquid. The carriage H/C of the liquid discharging apparatus carries thereon a head cartridge on which the liquid container 31 containing the ink therein and the liquid discharging head portion 30 are removably mountable, and is reciprocally movable widthwisely of a recording medium 50 (the directions of arrows a and b) such as recording paper conveyed by recording medium conveying means.

In the liquid discharging apparatus of the present embodiment, when a driving signal is supplied from driving signal supplying means, not shown, to liquid discharging means on the carriage HC, recording liquid is discharged from the liquid discharging head portion 30 to the recording medium 50 in conformity with this signal.

Also, the liquid discharging apparatus of the present embodiment has a motor 51 as a drive source for driving the recording medium conveying means and the carriage HC, gears 52 and 53 for transmitting the driving force from the drive source to the carriage HC, and a carriage shaft 54. By this recording apparatus and the liquid discharge effected by this recording apparatus, good records of images can be obtained on various kinds of recording mediums.

Figure 11:
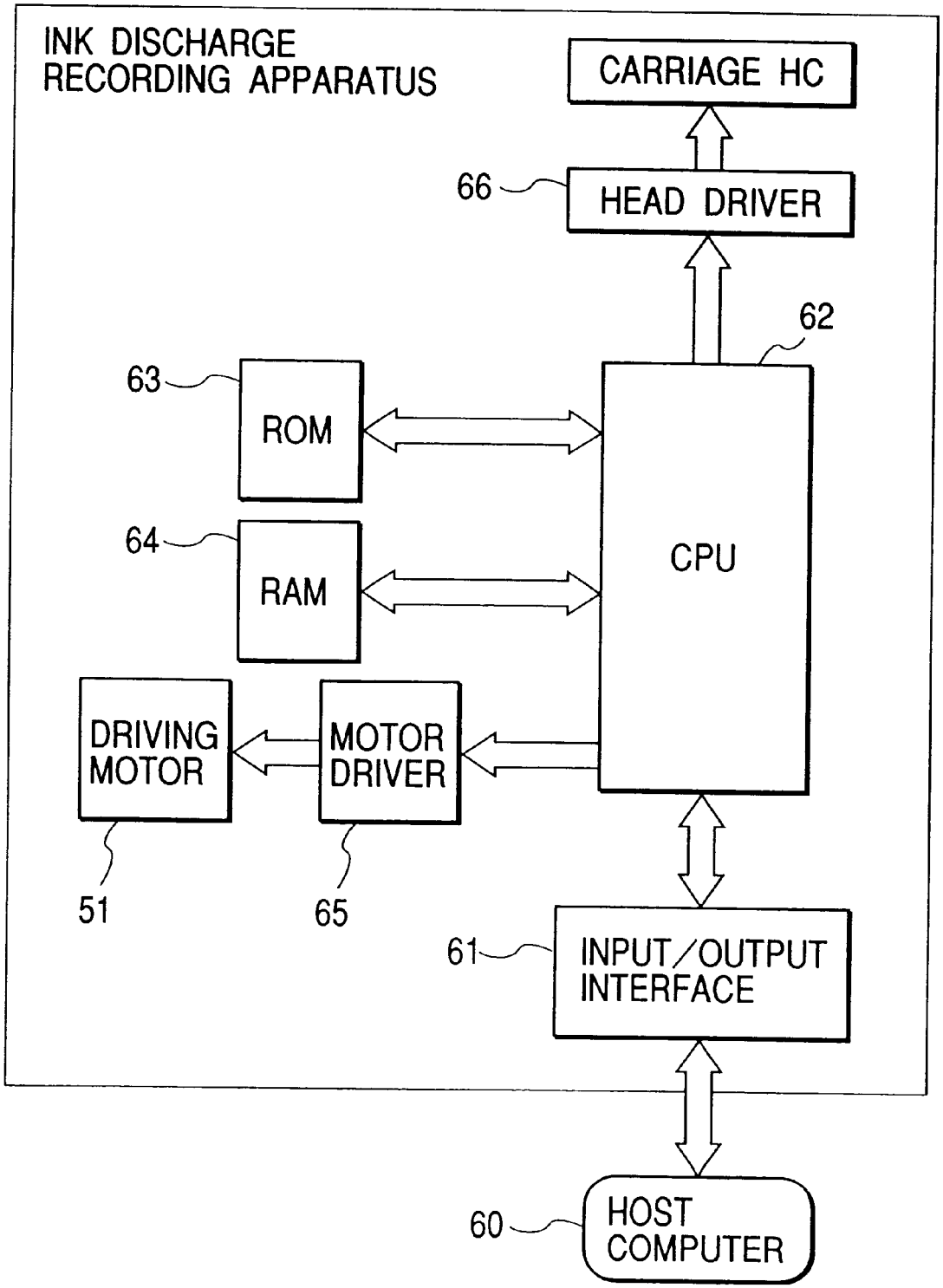
FIG. 11 is a block diagram of an entire apparatus for operating an ink discharge recording apparatus to which the liquid discharging head of the present invention is applied.
Figure 12A:
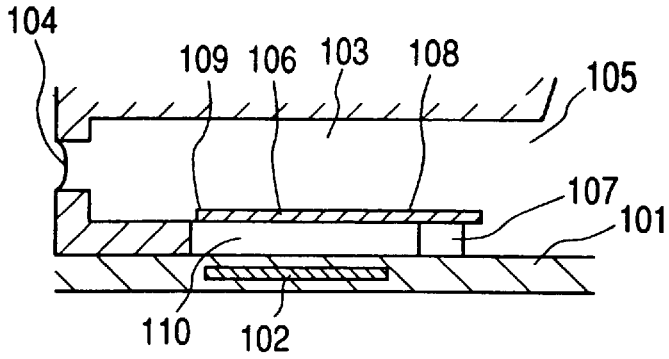
FIG. 12A PRIOR ART
FIGS. 12A, 12B, 12C and 12D are views for illustrating the principle of discharge in a liquid discharging head according to the prior art.
Figure 12B:
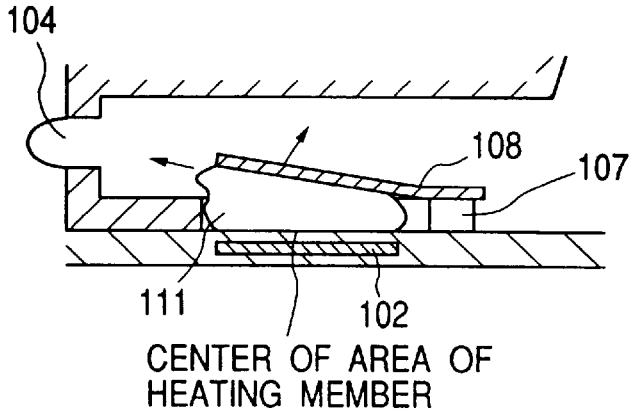
FIG. 12B PRIOR ART
Figure 12C:
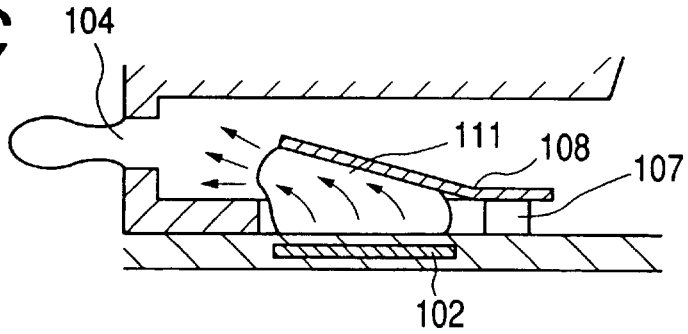
FIG. 12C PRIOR ART
Figure 12D:
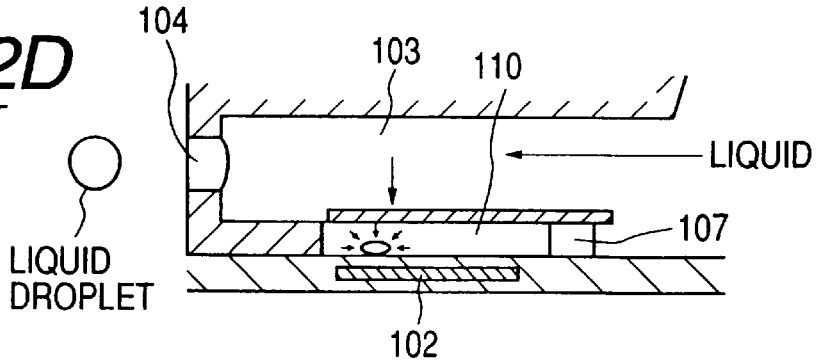
FIG. 12D PRIOR ART
Figure 13:
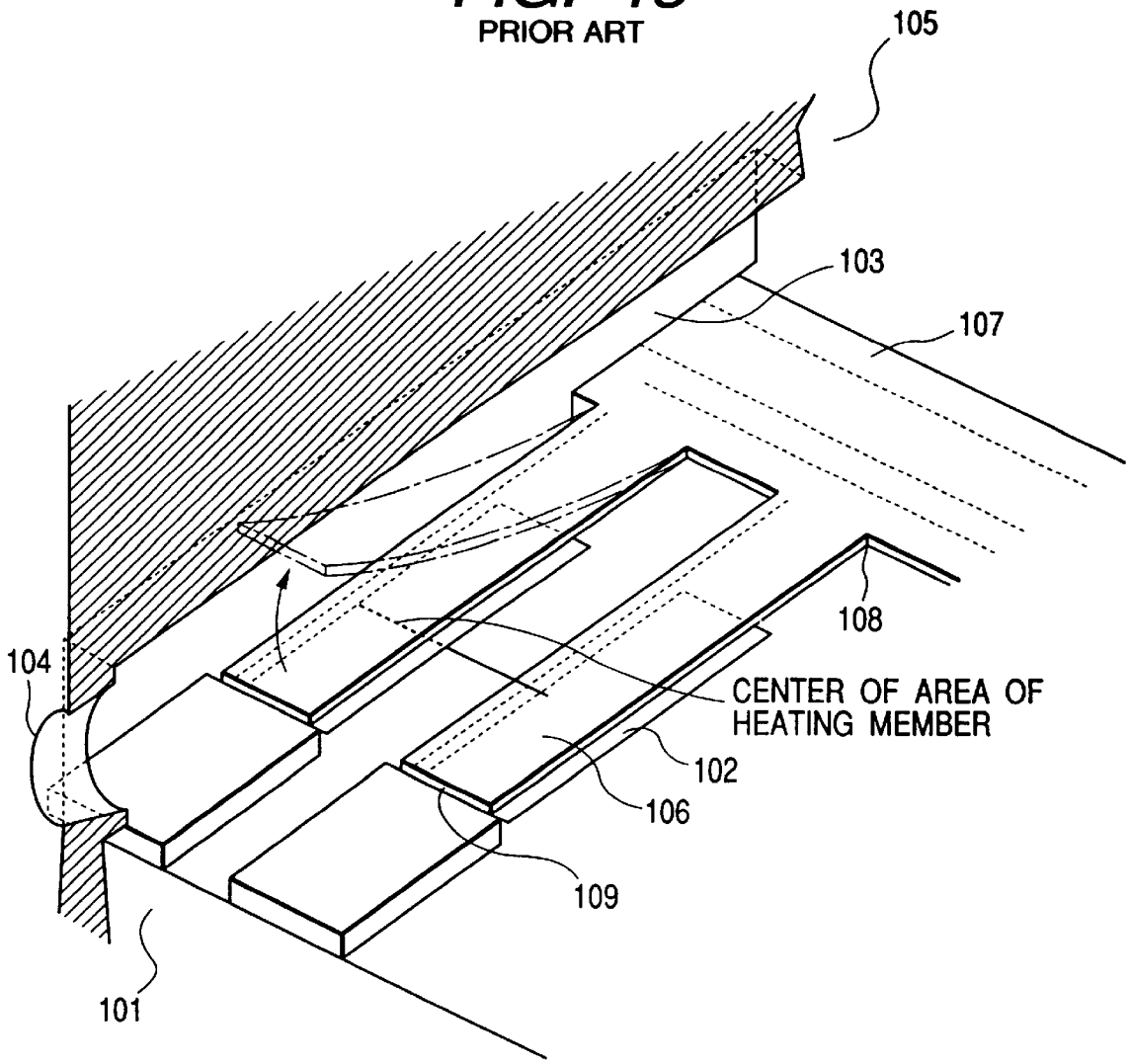
FIG. 13 PRIOR ART
FIG. 13 is a fragmentary broken-away perspective view of the liquid discharging head shown in FIGS. 12A to 12D.

FIG. 11 is a block diagram of an entire apparatus for operating the ink discharge recording apparatus to which the aforedescribed liquid discharging head is applied.

The recording apparatus receives printing information as a control signal from a host computer 60. The printing information is temporarily preserved in an input/output interface 61 in the recording apparatus and at the same time, is converted into data capable of being processed in the recording apparatus, and is inputted to a CPU 62 serving also as head driving signal supplying means. The CPU 62 processes the data inputted to the CPU 62 by the use of a surrounding unit such as a RAM 64 on the basis of a control program preserved in a ROM 63, and converted it into data to be printed (image data).

Also, the CPU 62 makes driving data for driving the drive motor 51 for moving the recording medium 50 and the carriage HC (see FIG. 10) in synchronism with the image data to record the image data at a suitable position on the recording medium. The image data and motor driving data are transmitted to the carriage HC and the drive motor 51, respectively, through a head driver 66 and a motor driver 65, and the carriage HC and the drive motor 51 are driven at controlled timing to thereby form an image.

The recording mediums which can be applied to the recording apparatus as described above and to which liquid such as ink is imparted include various kinds of paper, OHP sheets, plastic materials used for compact discs and decoration plates, fabrics, metallic materials such as aluminum and copper, leather materials such as oxhide, pigskin and artificial leather, wood such as trees and phywood, bamboo material, ceramic materials such as tiles, three-dimensional structures such as sponges, etc.

Also, the above-described recording apparatuses include a printer apparatus for effecting recording on various kinds of paper and OHP sheets, a recording apparatus for plastics for effecting recording on plastic materials such as compact discs, a recording apparatus for metals for effecting recording on metal plates, a recording apparatus for leather for effecting recording on leather, a recording apparatus for wood for effecting recording on wood, a recording apparatus for ceramics for effecting recording on ceramic materials, a recording apparatus for effecting recording on three-dimensional net-like structures such as sponges, a textile printing apparatus for effecting recording on fabrics, etc.

Also, it is preferable that the discharge liquid used in these liquid discharging apparatuses be liquid matching with respective recording mediums and recording conditions.

What is claimed is:

1. A liquid discharging head having:

at least a discharge port for discharging liquid therefrom;

a liquid flow path communicating with said discharge port to supply said liquid to said discharge port;

a substrate provided with a heating member for creating a bubble in said liquid filling said liquid flow path; and a movable member having a movable portion having its free end at said discharge port side and provided at a location facing said heating member of said substrate with a gap with respect to said substrate, a supported and fixed portion supported on and fixed to said substrate, and a supporting portion provided near said supported and fixed portion of said movable portion;

the free end of said movable member being displaced toward said discharge port side about a fulcrum portion of said movable member by pressure produced by said bubble being created to thereby discharge said liquid from said discharge port, characterized in that said movable member is formed of a silicon material and has a bent portion forming said gap, and said fulcrum portion has a curved surface shape.

2. A liquid discharging head according to claim 1, wherein the material of said movable member is silicon nitride, silicon oxide or silicon carbide.

3. A liquid discharging head according to claim 1, wherein said movable member has a curved surface shape inside the fulcrum portion.

4. A liquid discharging head according to claim 1, wherein said movable member has a curved surface shape outside the fulcrum portion.

5. A liquid discharging head according to claim 1, wherein said substrate has an inorganic insulating protective layer on said heating member.

6. A liquid discharging head according to claim 1, wherein a cavitation-resisting layer is provided on the surface of said substrate.

7. A liquid discharging head according to claim 6, wherein a closely contacting layer is provided between the supported and fixed portion of said movable member and said substrate.

8. A liquid discharging head according to claim 7, wherein tantalum is contained in the material of said closely contacting layer.

9. A liquid discharging head according to claim 8, wherein the material of said closely contacting layer is tantalum pentoxide.

10. A liquid discharging head according to claim 1, wherein said movable member has a gap with respect also to that surface of the flow path which faces the substrate in the steady state thereof.

11. A liquid discharging head according to claim 1, wherein the gap between said substrate and said movable member is 1 to 20 $\mu$m.

12. A liquid discharging head according to claim 1, wherein the gap between said substrate and said movable member is 1 to 10 $\mu$m.

13. A liquid discharging head according to claim 1, wherein the thickness of said movable member is 1 to 5 $\mu$m.

14. A head cartridge having a liquid discharging head according to any one of claims 1 to 13, and a liquid container for holding the liquid to be supplied to said liquid discharging head.

15. A liquid discharging apparatus having a liquid discharging head according to any one of claims 1 to 13, and driving signal supplying means for supplying a driving signal for discharging the liquid from said liquid discharging head.

16. A liquid discharging apparatus according to claim 15, wherein ink is discharged from said liquid discharging head, and said ink is caused to adhere to a recording medium to thereby effect recording.

17. A liquid discharging apparatus having a liquid discharging head according to any one of claims 1 to 13, and recording medium conveying means for conveying a recording medium receiving the liquid discharged from said liquid discharging head.

18. A liquid discharging apparatus according to claim 17, wherein ink is discharged from said liquid discharging head, and said ink is caused to adhere to a recording medium to thereby effect recording.

19. A method of manufacturing a liquid discharging head provided with:

a discharge port for discharging liquid therefrom;

a liquid flow path communicating with said discharge port to supply said liquid to said discharge port;

a substrate provided with a heating member for creating a bubble in said liquid filling said liquid flow path; and a movable member having a movable portion having its free end at said discharge port side and provided at a location facing said heating member of said substrate with a gap with respect to said substrate, a supported and fixed portion supported on and fixed to said substrate, and a supporting portion provided near said supported and fixed portion of said movable portion;

the free end of said movable member being displaced toward said discharge port side about a fulcrum portion constructed near the supported and fixed portion of said movable member with respect to said substrate by pressure produced by said bubble being created, thereby discharging said liquid from said discharge port;

said method comprising:

the step of forming a gap forming member for forming said gap on said substrate;

the step of forming on said substrate and said gap forming member a base material layer for the movable member formed of a silicon material forming said movable member;

the step of patterning said base material layer for the movable member and forming said movable member; and the step of removing said gap forming member; and wherein the step of forming that portion of said gap forming member which forms the fulcrum portion of said movable member into a curved surface shape is performed before the step of forming on said substrate and said gap forming member the base material layer for the movable member forming said movable member.

20. A method of manufacturing a liquid discharging head according to claim 19, wherein the step of forming that portion of said gap forming member which forms the fulcrum portion of said movable member into a curved surface shape has:

the step of forming resist for patterning said gap forming member on said substrate; and the step of removing that portion of said gap forming member which is not covered with said resist by etching.

21. A method of manufacturing a liquid discharging head according to claim 20, wherein a closely contacting property between said gap forming member and said resist is made weaker than a closely contacting property between said gap forming member and said substrate.

22. A method of manufacturing a liquid discharging head according to claim 20, wherein as the material of said resist, use is made of a material in which the selection ratio of the etching to said gap forming member is about 1:1.

23. A method of manufacturing a liquid discharging head according to claim 19, having the step of removing a corner portion formed on the boundary between the surface of said gap forming member and that portion forming the fulcrum portion of said movable member after the step of forming that portion of said gap forming member which forms the fulcrum portion of said movable member into a curved surface shape.

24. A method of manufacturing a liquid discharging head according to claim 23, wherein the step of removing a corner portion formed on the boundary between the surface of said gap forming member and the portion forming the fulcrum portion of said movable member comprises the step of carrying out heat treatment for fusing the corner portion of said gap forming member.

25. A method of manufacturing a liquid discharging head according to claim 19, wherein as the material of said gap forming member, use is made of highly heat-resisting resist having a feature that when exposure and developing process are carried out, a convex curved surface-like slope is formed on the end portion.

26. A method of manufacturing a liquid discharging head according to claim 19, wherein as the material of said movable member, use is made of silicon nitride, silicon oxide or silicon carbide.

27. A method of manufacturing a liquid discharging head according to claim 19, having the step of forming a closely contacting layer on said substrate before the step of forming the gap forming member for forming said gap on said substrate.

* * * * *

UNITED STATES PATENT AND TRADEMARK OFFICE

CERTIFICATE OF CORRECTION

PATENT NO. : 6,196,667 B1
DATED : March 6, 2001
INVENTOR(S) : Tomoyuki Hiroki et al.

It is certified that error appears in the above-identified patent and that said Letters Patent is hereby corrected as shown below:

Column 1,
Line 41, "disped" should read -- disposed --.

Signed and Sealed this

Fifth Day of March, 2002

*Attest:*

*Attesting Officer*

JAMES E. ROGAN
*Director of the United States Patent and Trademark Office*